US006798330B2

(12) United States Patent
Arikawa et al.

(10) Patent No.: US 6,798,330 B2
(45) Date of Patent: Sep. 28, 2004

(54) MINIATURE FUSE OF SURFACE-MOUNT TYPE

(75) Inventors: Hiroo Arikawa, Tokyo (JP); Koh Ishimura, Tochigi (JP); Seiji Norisue, Tochigi (JP)

(73) Assignee: SOC Corporation, Tokyo (JP)

( * ) Notice: Subject to any disclaimer, the term of this patent is extended or adjusted under 35 U.S.C. 154(b) by 0 days.

(21) Appl. No.: 10/068,954

(22) Filed: Feb. 11, 2002

(65) Prior Publication Data

US 2002/0113684 A1 Aug. 22, 2002

(30) Foreign Application Priority Data

Feb. 16, 2001 (JP) ..... 2001/039279
Dec. 5, 2001 (JP) ..... 2001/370902

(51) Int. Cl.[7] ..... H01H 85/175; H01H 85/165

(52) U.S. Cl. ..... 337/231; 337/248; 337/246; 337/228; 337/187

(58) Field of Search ..... 337/163, 166, 337/186, 187, 227, 228, 246, 248, 231, 232, 260; 29/623

(56) References Cited

U.S. PATENT DOCUMENTS

| | | | | | |
|---|---|---|---|---|---|
| 1,377,398 | A | * | 5/1921 | Conrad | 337/246 |
| 3,460,086 | A | * | 8/1969 | Fister | 337/202 |
| 3,721,936 | A | * | 3/1973 | Belcher | 337/241 |
| 4,057,774 | A | | 11/1977 | Arikawa et al. | |
| 4,122,426 | A | | 10/1978 | Maruo | |
| 4,158,187 | A | * | 6/1979 | Perreault | 337/248 |
| 4,297,666 | A | | 10/1981 | Asdollahi | |
| 4,646,053 | A | | 2/1987 | Mosesian | |
| 4,656,453 | A | * | 4/1987 | Reeder | 337/236 |
| 4,684,915 | A | * | 8/1987 | Knapp, Jr. | 337/276 |
| 4,703,299 | A | * | 10/1987 | Vermij | 337/158 |
| 4,851,805 | A | * | 7/1989 | Poerschke | 337/231 |
| 5,153,553 | A | * | 10/1992 | Ruehl et al. | 337/273 |
| 5,214,406 | A | * | 5/1993 | Reese et al. | 337/231 |
| 5,280,261 | A | * | 1/1994 | Mollet | 337/158 |
| 6,507,265 | B1 | * | 1/2003 | Ackermann | 337/278 |

FOREIGN PATENT DOCUMENTS

| | | | |
|---|---|---|---|
| DE | 364 719 | 11/1922 | |
| DE | 94 07 550 | 9/1994 | |
| FR | 2679378 A1 * | 1/1993 | ..... H01H/85/175 |

* cited by examiner

*Primary Examiner*—Anatoly Vortman
(74) *Attorney, Agent, or Firm*—Wenderoth, Lind & Ponack, L.L.P.

(57) ABSTRACT

A miniature fuse of surface mount type having a stable pre-arcing time-current characteristic and a strong time lag characteristic The fuse is easy to produce, and provides a constant pre-arcing time. The main body of the fuse is of rectangular ceramic construction of split type. A fusible member (60) wound around a ceramic rod (58) and is rested on a recessed portion (62) of the lower ceramic casing (54). The end portion (76) of the fusible member (60) is engaged with the side surface of the casing. The upper ceramic casing (52) is laid on the lower casing, so that the caps (56) are fit onto the opposite ends of the main body. The end portion (76) of the fusible member (60) and the cap (56) are connected by welding. At the time of welding, projections (74) to be fit in the recessed portions (72) provided at the main body, is formed at the cap (56), so that the cap (56) can be fixed to the main body.

10 Claims, 10 Drawing Sheets

MINIATURE FUSE OF SURFACE-MOUNT TYPE

BACKGROUND OF THE INVENTION

The present invention relates to a miniature fuse of surface mount type. In particular, the present invention is suitable for a micro-miniature fuse of surface mount type which can be used for protection of apparatuses for communication and whose longitudinal length does not exceed 11 mm.

Apparatuses for communication to be connected to telephone lines and the like are liable to be subjected to high surge current due to indirect lightning strikes, or sudden and unusually high increases in voltage due to telephone lines accidentally coming into contact with power lines. Thus, fuses to be used for apparatuses for communication require both a strong time lag characteristic preventing the fuses from being melted by the surge current due to indirect lightning strikes as well as a high breaking capacity in the order of 60A at AC600V which assures a big fault current flow at the moment of the accidental power line contact to be safely switched off. Furthermore, as the apparatuses for communication become increasingly miniaturized, micro-miniature sized fuses are required to have a strong time lag characteristic and a high breaking capacity, they are also required to be of a surface mount type so that surface mounting of high density may be carried out. Thus far there have been provided inner soldered fuses which are constructed in such a manner as shown in FIG. 1 and FIG. 2, wherein a fusible member 102 is wound around a support member of insulating material made up of bundled glass fibers and the respective ends of the fusible member 102 are soldered to the recessed bottom of the conductive terminals 104 of cap-like configuration.

A disadvantage of the inner soldered type fuse is that the electrical resistances of produced fuses disperse widely from designed value so that the pre-arcing time may often be uneven. In accordance with an inner soldering type, when a soldering iron is placed from the outside of the cap-like terminal 104 so as to melt the solder 106 attached to the interior of the recess of the cap terminal 104 to solder the fusible member 102 wound around the bundled glass fibers 100 to the bottom of the recess of the cap terminal 104, melted soldering material will be caused to flow along the fusible member 102 wound around the bundle of the glass fibers 100, resulting in a clogging of the spaces between the adjacent portions of the wound fusible member 102 to make short-circuits between them. As a result, the length of the fusible member 102 which is in the short-circuit state may result in one-third of overall length of the fusible member, and thus the performance of fuses may be changed entirely. In addition to the above, it also often happens that at the time of breaking, the soldering material inside the cap terminal will be vaporized and arc will be sustained, making it impossible for the breaking to be performed, which is also a disadvantage.

Further, the conductive cap-like terminals 104 and the main body 108 made of an insulating material are secured by the frictional force caused by coagulation of the soldering material which has flowed into the space between the cap terminals and the main body. In the case of fuses of surface mount type, when such fuses are mounted on a substrate by means of soldering, the fuses are also heated to a temperature of soldering. Since the soldering temperature profiles differ from manufacturer to manufacturer, in the case of high temperature soldering, the soldering materials within the fuses, namely the soldering materials which have entered between the conductive cap-like terminals 104 and the main body 108 are caused to melt, whereby the conductive cap-like terminals 104 might possibly be detached from the main body 108, which was considered a problem Furthermore, since the melting point of the soldering material which does not contain lead in view of problems associated with its use tends to be relatively high, the soldering temperature at the time of mounting fuses on a substrate is likely to be further increased, which is another problem that will have to be solved.

As shown in FIG. 1 and FIG. 2, the main body 108 has a columnar configuration and a through hole 110 is so provided as to extend between the opposite end faces of the main body in the longitudinal direction. Since a miniature fuse of surface mount type is so small, in the order of 11 mm in respect of the overall length, the diameter of such a through hole is also very small. Accordingly, since the support member 100 with the fusible member 102 wound therearound had to be inserted through a small inlet on the end face of the main body 108, workability in the course of manufacturing was consequently poor.

SUMMARY OF THE INVENTION

An object of the present invention is to provide a miniature fuse of surface mount type which has a stable pre-arcing time-current characteristic without uneven performance and a strong time lag characteristic and, in addition, a large breaking capacity.

Another object of the present invention is to provide a miniature fuse of surface mount type which has a stable pre-arcing time current characteristic without uneven performance and a large breaking capacity.

A further object of the present invention is to provide a miniature fuse of surface mount type which is easy to manufacture.

The object of the present invention mentioned above may be accomplished by a miniature fuse of surface mount type according to the present invention including a fusible member, a support member adapted to support said fusible member, a main body made of heat resistant insulating material and a pair of conductive terminals, wherein said main body includes a pair of opposed end portions and a cavity defined inside of the main body between said pair of end terminals, the middle part of said fusible member is wound around said support member and, in this condition, disposed in said cavity between a pair of end portions, the opposite end portions of said fusible member are extended outwardly onto the peripheral surface of said main body from a pair of end portions of said main body or from the vicinities thereof, the respective conductive terminals are fit onto the respective end portions of said main body, and connected electrically and mechanically to the respective end portions of said fusible member, and wherein said support member is made of a material that has ease of shape formation, has pressure resistant strength, containing in terms of weight ratio $Al_2O_3$ exceeding 96%, MgO exceeding 3%, and BeO less than 1%; said fusible member is made of a metallic material having a low melting temperature and containing in terms of weight ratio Ag equal to or exceeding 50%, Cu equal to or exceeding 20%, Zn equal to or exceeding 17% and Sn equal to or exceeding 5%; and said electrical and mechanical connection is executed by welding.

According to an aspect of the present invention, it is preferable that cut-out recessed portions are formed at two locations along the diagonal line on the outer peripheral surface at the opposite end portions of said main body in contact with the end surfaces of said main body, and the respective end portions of said fusible member are engaged with said cut-out recessed portions.

According to another aspect of the present invention, it is preferable that said main body has a columnar configuration; said conductive terminals are of cap-like configuration having recessed portions to be fit onto the opposite end portions of said main body; and lids of thin sheet made of insulating material and having a thickness smaller than the depth of said recessed portions are provided between the end surfaces of said main body and the bottom of the recessed portions of said conductive terminals.

The second object of the present invention mentioned above may be accomplished by a miniature fuse of surface mount type according to the present invention including a fusible member, a main body made of heat resistant insulating material, and a pair of conductive terminals, wherein said main body includes a pair of opposing end portions and a cavity defined inside the main body between said pair of end portions, said fusible member is disposed in said cavity of said main body between said pair of end portions, the opposite end portions of said fusible member are extended outwardly onto the outer surface of said main body from a pair of end portions of said main body or from the vicinities thereof, the respective conductive terminals are fit onto the respective end portions of said main body, and connected electrically and mechanically to the respective end portions of said fusible member, and wherein said electrical and mechanical connection is executed by welding.

The third object of the present invention mentioned above may be accomplished by a miniature fuse of surface mount type according to the present invention including a fusible member, a main body made of heat resistant insulating material and a pair of conductive terminals, wherein said main body has a columnar configuration and a cavity defined inside of the main body between the opposite end portions, said fusible member is disposed in said cavity of said main body between said opposite end portions, the opposite end portions of said fusible member are extended outwardly onto the outer surface of said main body from the opposite end portions of said main body or from the vicinities thereof, the respective conductive terminals are fit onto the respective end portions of said main body and electrically connected to the respective end portions of said fusible member, and wherein said main body is comprised of two split members which are separated in the direction of connecting the opposite end portions; and recessed portions extending to the split end surface are provided, as the recessed portions of said main body, in the vicinities of the respective end portions of the side surfaces of at least one of said split members forming the columnar configuration of the main body, whereby workability in the course of manufacturing may be improved.

According to an aspect of the present invention, it is preferable that recessed portions extending to the split end surfaces are provided in the vicinities of the respective end portions of the side surfaces of the other of said split members forming the columnar configuration of the main body; and the recessed portions of two split members are adapted to form one recessed portion at the side surfaces forming the columnar configuration when said two split members are jointed to form said main body.

According to another aspect of the present invention, it is preferable that said conductive terminals are metallic caps; the end portions of said fusible members are connected to said caps by welding, and projections adapted to fit in the recessed portions of said main body are formed at said caps by said welding in order to fix said caps to said main body.

According to a further aspect of the present invention, said main body is preferably made of ceramic material.

According to the present invention, the support member is made of a material that has ease of shape formation, has pressure resistant strength, and contains in terms of weight ratio $Al_2O_3$ exceeding 96%, MgO exceeding 3%, and BeO less than 1%; the fusible member is made of a metallic material having a low melting temperature and containing in terms of weight ratio Ag equal to or exceeding 50%, Cu equal to or exceeding 20%, Zn equal to or exceeding 17% and Sn equal to or exceeding 5%; and the electrical and mechanical connection is executed by welding so that the pre-arcing time-current characteristic can be kept stable and a strong time lag characteristic can be provided and a high breaking capacity in the order of 60A at AC 600V without sustaining arcs due to metallic vaporization of the soldering materials can be attained.

Further according to the present invention, since the conductive terminals and the fusible member are connected by welding, a steady pre-arcing time-current characteristic and a large breaking capacity can be attained without uneven performance, and the miniature fuse of surface mount type may not be affected by the heat generated at the time of soldering the miniature fuse of surface mount type to a printed circuit board after assembly, whereby stable connection between them can be maintained at the time of mounting the fuse to the printed circuit board.

Still according to the present invention, since the main body is comprised of two split members which are separated in the direction of connecting the opposite end portions, and recessed portions extending to the split end surface are provided, as the recessed portions of said main body, in the vicinities of the respective end portions of the side surfaces of at least one of said split members forming the columnar configuration of the main body, such a construction as having a recessed portion at the side surface of the main body can be manufactured by press molding and the fusing member can be extended in a casing of a fuse easily, whereby production of miniature fuse of surface mount type can be made easy, automated production can also be facilitated and production rate can be enhanced.

DETAILED DESCRIPTION OF THE INVENTION

Figure 1:
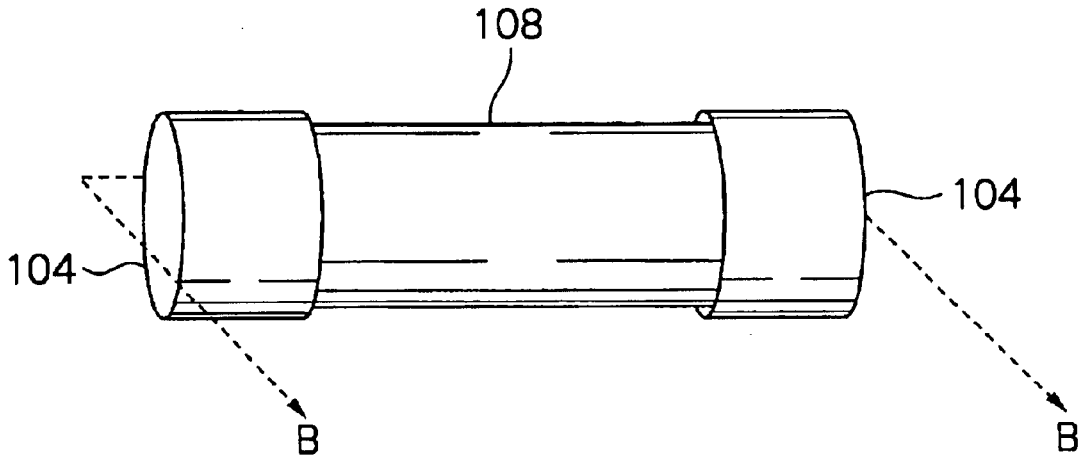
Fig. 1 PRIOR ART
FIG. 1 is a perspective view showing a prior art fuse made of glass tube.
Figure 2:
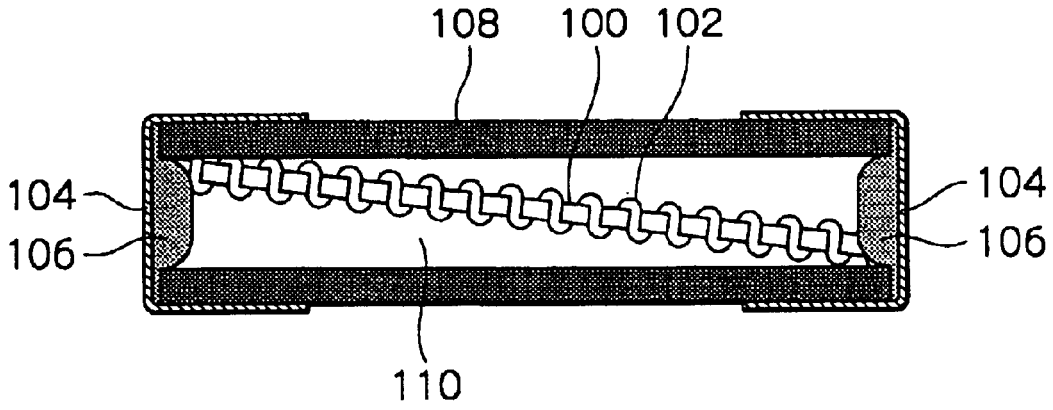
Fig. 2 PRIOR ART
FIG. 2 is a sectional view taken along the line B—B in FIG. 1.

Preferred embodiments of the present invention will now be explained with reference to the accompanying drawings. It is to be understood that throughout the present specification and the accompanying drawings, the components designated by same or similar reference numerals indicate those components having same or similar functionality and construction.

Figure 3:
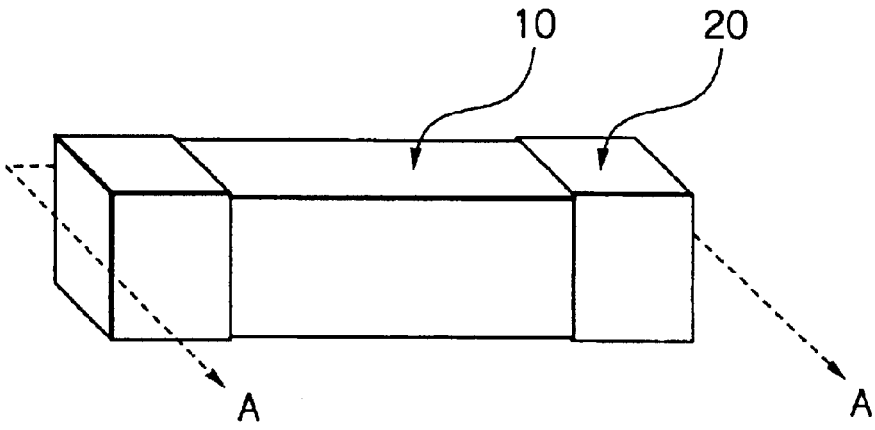
FIG. 3 is a perspective view showing an embodiment of the present invention.
Figure 4:
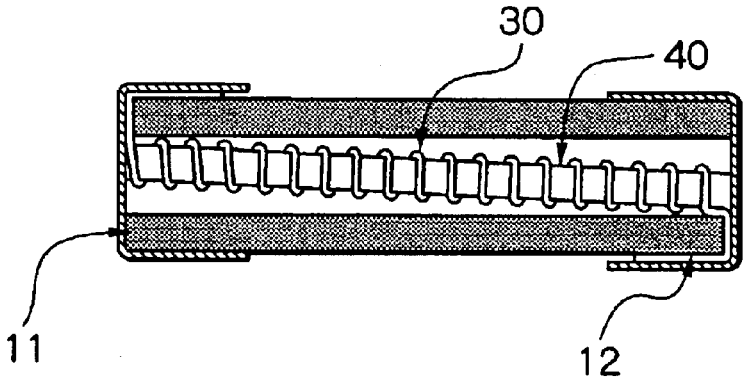
FIG. 4 is a sectional view taken along the line A—A in FIG. 3.

With reference to FIG. 3 and FIG. 4, the main body 10 is made, of heat resistant insulating material and has a columnar configuration and is provided with a through-hole extending through the main body between the opposite end faces 11 in the longitudinal direction. While the fusible member 30 is extended through the through-hole, the middle part of the fusible member 30 is wound spirally around the support member 40 and the respective end portions of the fusible member 30 are bent along the end faces 11 of the main body and engaged with the outer peripheral surface of the end portions 12 of the main body 10. The conductive terminals 20 having a cap-like configuration provided with recessed portion of which sectional shape is substantially identical with that of the end portions 11 so that the terminals may be fit onto the opposite end portions 12 of the main body 10 are fit onto the opposite end portions of the main body 10. With the conductive terminals 20 thus fit onto the main body 10, the terminals 20 of cap-like configuration and the fusible members 30 are electrically connected to each other by welding.

For the composition of the material of the support member having high thermal conductivity coefficient, in terms of weight ratio, $Al_2O_3$ exceeding 96%, MgO exceeding 3% and BeO less than 1% are contained. The fusible member having a low melting temperature is wound around the support member, the fusible member being made of material containing in terms of weight ratio Ag equal to or exceeding 50%, Cu equal to or exceeding 20%, Zn equal to or exceeding 17% and Sn equal to or exceeding 5%.

Figure 5:
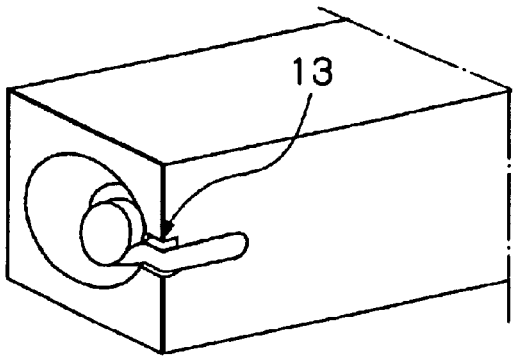
FIG. 5 is a fragmentary assembly drawing excluding the terminals of cap-like shape according to an embodiment of the present invention.

As shown in FIG. 5, when cut-out recessed portions 13 are formed on the outer peripheral surface of the opposite end portions of the main body at two positions on the diagonal line in contact with the end surfaces of the main body, the respective end portions of the fusible member 30 are engaged with the cut-out recessed portions.

Thin lids made of insulating sheet material having a thickness smaller than the depth of the conductive terminal 20 of cap-like configuration having a substantially identical shape to that of the bottom face of the conductive terminals 20 may be disposed between the end surface 11 of the main body 10 and the bottom face of the terminals 20 of cap-like configuration.

Figure 6:
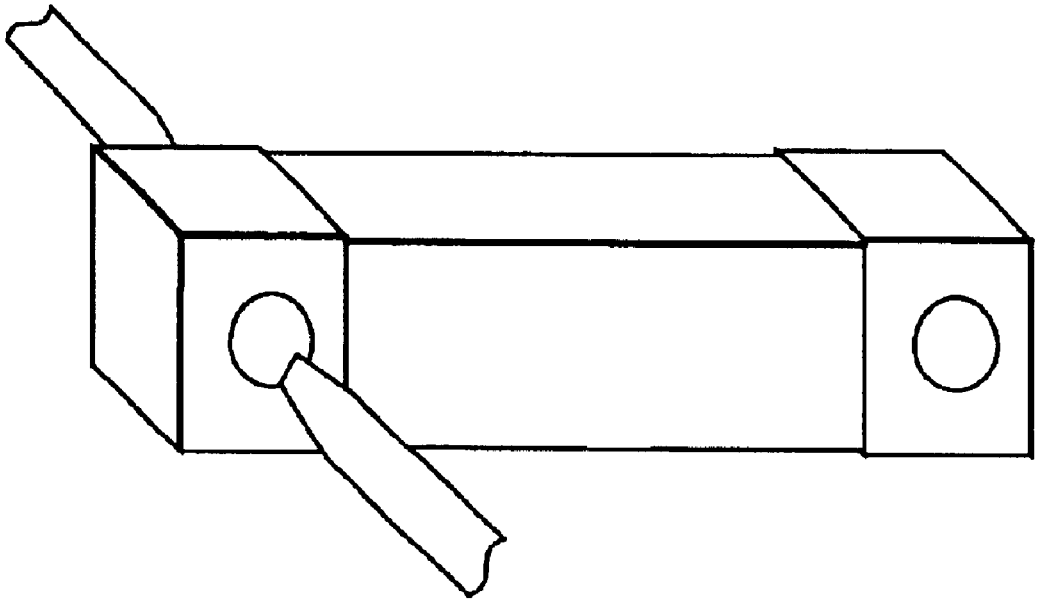
FIG. 6 is a perspective view showing the position of the welding electrode according to an embodiment of the present invention.

According to such a construction as mentioned above, the respective end portions of the fusible member 30 which is extended inside of the main body 10 along the diagonal line are bent along the opposite end surfaces of the main body and engaged with the outer peripheral surface of the end portions 12. The terminals 20 of cap-like configuration are fit onto the opposite end portions 12 of the main body 10 and, as shown in FIG. 6, the opposite side surfaces of the terminals 20 of cap-like configuration are welded and fixed. The support member having a higher thermal conductivity coefficient is caused to radiate the Joule heat generated due to flow of current through the fusible member 30 out of the fuse through the terminals 20 of cap-like configuration at the opposite ends, thereby preventing the temperature of the metal having a low melting temperature from rising and providing a strong time lag characteristic. When a large current flows, the metal having a low melting temperature can be melted with a smaller Joule heat compared to the metal having a higher melting temperature. Accordingly, the fuse according to the present invention, despite being of a micro-miniature size, can have a high breaking capacity such as AC 600V at 60A.

For facilitating understanding of the present invention, the embodiments of the present invention will now be explained again by referring to FIG. 3, FIG. 4 and FIG. 5.

FIG. 3 is the perspective view illustrating an embodiment of the invention while FIG. 4 is the sectional view taken along the line A—A in FIG. 3. As shown in FIG. 4 and FIG. 5 cut-out recessed portions 13 are formed on the outer peripheral surface of the opposite end portions 12 of the main body 10 of a columnar configuration made of heat resistant insulating material in contact with the end surfaces 11 of the main body 10. As shown in FIG. 4, the middle part of the fusible member 30 which is extended inside the main body along the diagonal line is wound spirally around the support member 40 and the respective end portions of the fusible member 30 are engaged with the cut-out recessed portions 13. After the terminals 20 of cap-like configuration are fit onto the end portions of the main body 10, the opposite side surfaces of the terminals of cap-like configuration in parallel with the outer peripheral surface of the main body 10 on which the cut-out recessed portions 13 with the end portions of the fusible member 30 engaged therewith are welded with the welding electrodes held in such a manner as to sandwich the side surfaces, thereby providing the fuse of the present invention which does not exceed a length of 11 mm.

In the micro-miniature fuse of surface mount type according to the present invention, the fusible member 30, the terminals 20 of cap-like configuration and the main body 10 are electrically and mechanically connected by welding without use of soldering, whereby the pre-arcing time-current performance of the fuse becomes stable and a strong time lag characteristic and a high breaking performance as 60A at AC 600V can be attained without metallic vaporization of the soldering material and sustaining arcs.

Figure 7:
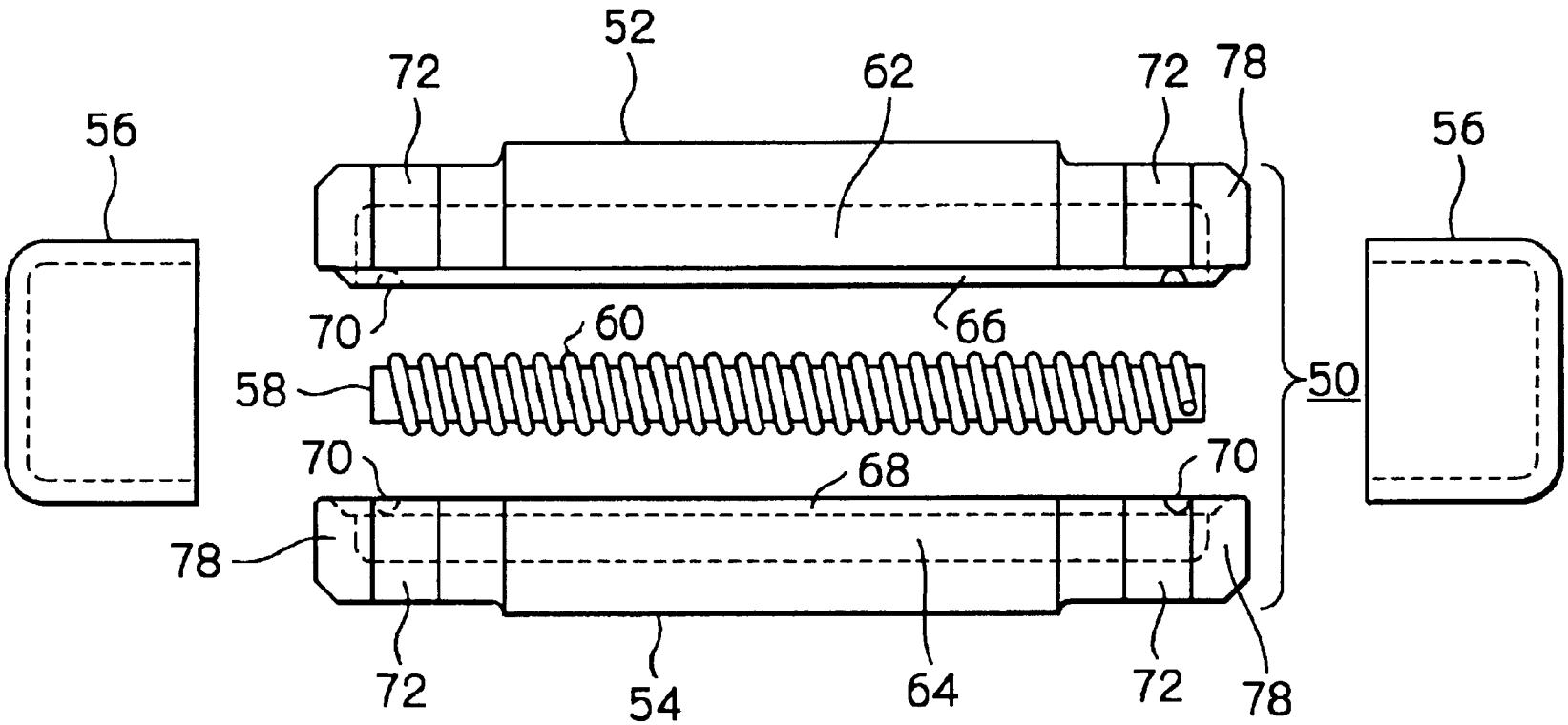
FIG. 7 is an exploded view of the miniature fuse of surface mount type according to a second embodiment of the present invention.
Figure 8:
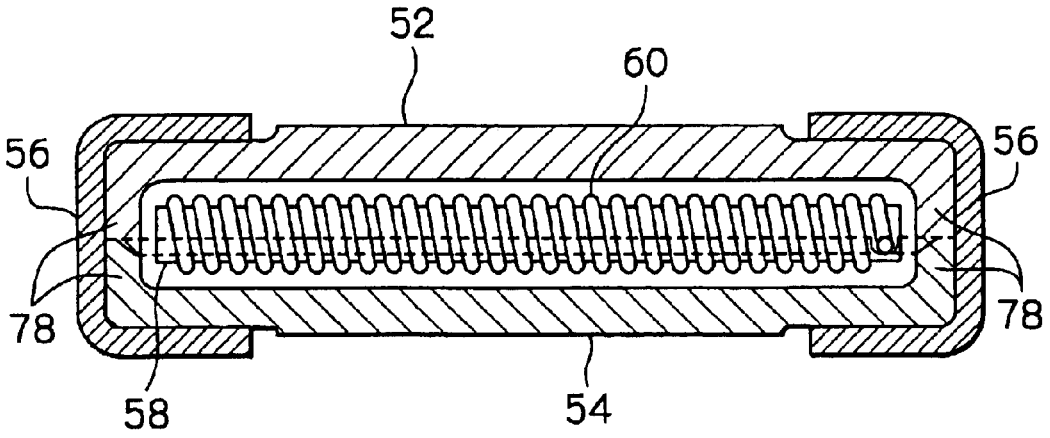
FIG. 8 is a longitudinal sectional view of the miniature fuse of surface mount type according to the second embodiment of the present invention in the side surface direction.
Figure 9:
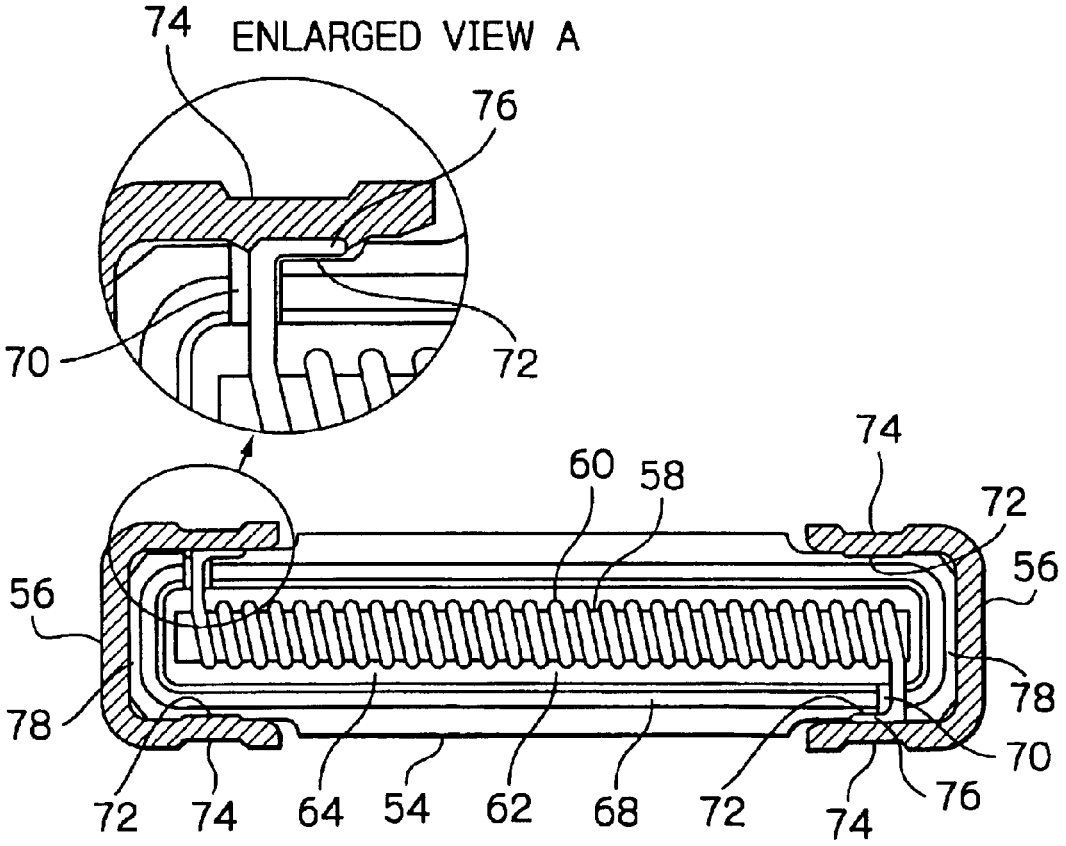
FIG. 9 is a longitudinal sectional view of the miniature fuse of surface mount type according to the second embodiment of the present invention in the upper surface direction.

Now, the second preferred embodiment of the miniature fuse of surface mount type according to the present invention will be explained with reference to FIG. 7, FIG. 8 and FIG. 9. FIG. 7 is exploded assembly drawing of the miniature fuse of surface mount type according to the second embodiment. FIG. 8 is longitudinal sectional view of the miniature fuse of surface mount type according to the second embodiment viewed in the direction of side surface. FIG. 9 is longitudinal sectional view of the miniature fuse of surface mount type according to the second embodiment in the direction of upper surface. In these drawings, reference numeral 50 designates a rectangular split casing of ceramic material forming the main body of the miniature fuse of surface mount type. The rectangular split casing 50 of ceramic material consists of the upper ceramic casing 52 and the lower ceramic casing 54 Reference numeral 56 designates the cap serving as the conductive terminal having a recessed portion having the sectional shape substantially identical to that of the opposite end portions of the casing 50 so as to be fit onto the opposite end portions of the rectangular ceramic split casing 50. Reference numeral 58 designates the ceramic rod adapted to support the elongated fusible member 60. The ceramic material to be used for the rectangular split casing 50 may be those ceramic materials which may be generally used for miniature fuses of surface mount type. According to the invention, the material to be used for the rectangular ceramic split casing 50 is not limited to ceramic material, and any heat resistant insulating material which may be press molded such as thermosetting resin and the like, may be applied. It is preferable that the cap 56 is made of basic material composed of copper or brass and then plated with tin, nickel or silver. The material of the cap 56 is not limited to those materials as mentioned above, and any material may be utilized so long as welding with the fusible member 60, as explained later, and connection with the connection lands and the like on a printed circuit board after completion of the fuse production process are feasible. Furthermore, surface treatment of the basic material is not limited to plating and any treatment other than plating may be applied. The ceramic rod 58 is preferably made of ceramic material containing a composition having a high thermal conductivity coefficient as mentioned above and containing in terms of weight ratio Al203 exceeding 96%, MgO exceeding 3% and BeO less than 1%. However, the present invention is not limited to this material, and other ceramic materials or insulating materials having different compositions may be applied. The fusible member 60 is preferably composed of metal having a low melting temperature containing in terms of weight ratio Ag equal to or exceeding 50%, Cu equal to or exceeding 20%, Zn equal to or exceeding 17% and Sn equal to or exceeding 5%. However, the present invention is not limited to this material and it may contain other metals.

The split type casing according to the present invention will be now explained in detail. As particularly shown in FIG. 7 the rectangular split type casing 50 is constructed by upper ceramic casing 52 and the lower ceramic casing 54 which are substantially equally divided at the longitudinal direction of the rectangular column. As shown in FIG. 7, the upper ceramic casing 52 and the lower ceramic casing 54 are respectively provided with recesses 62 and 64 at the opposite sides to be matched so that a cavity may be formed inside of the casing when they are jointed. A projection 66 is provided as shown in FIG. 7 at the end surface to be joined (this end surface hereinafter referred to as "Joint end surface") of the upper ceramic casing 52 while a recess 68 to be fit in the projection 66 of the upper ceramic casing 52 is provided at the joint end surface of the upper ceramic casing 54 as shown in FIG. 7 so that when the upper ceramic casing 52 and the lower ceramic casing 54 are jointed, they are accurately jointed without sliding laterally. It is to be noted that the projection 66 and the recess 68 may be entirely along the end surfaces or partially along the end surfaces. As shown in FIG. 7 and FIG. 9, cut-out portions 70 of semi-circular shape for leading out one end of the fusible member 60 are respectively provided at the joint end surfaces on one side surface of one end portion of the upper ceramic casing 52 and the lower ceramic casing 54 while cut-out portions 70 are provided at the joint end surfaces on the other side surface opposite to the one side surface of the other end portion of the upper ceramic casing 52 and the lower ceramic casing 54. Furthermore, as shown in FIG. 7 and FIG. 9, recessed portions 72 which constitute one integral recessed portion when both upper and lower casings are joined are provided at the opposite side surfaces of the respective end portions of the upper ceramic casing 52 and the lower ceramic casing 54 to extend to the Joint end surfaces. It is to be noted that the recessed portion 72 shown in FIG. 7 extends along the upper surface and the lower surface of the upper and the lower ceramic casings so as to facilitate press molding. Even if they extend along the upper and lower surfaces halfway, press molding may be performed, so this variation is also included in the scope of the present invention. The purpose of these recessed portions 72 is to enable the cap 56 to be fixed to the rectangular split type casing 50 of ceramic material. The manner of fixing by use of these recessed portions will be explained later. In the case that the rectangular ceramic casing 50 is not of a split type but one piece unit, one complete recessed portion as mentioned above can not be manufactured by press molding, and subsequent to molding, additional time-consuming and costly processes such as grinding and the like may be required. According to the present invention, however, owing to the split type, when the upper and the lower ceramic casings 52 and 54 are molded, the recessed portions can be easily manufactured simultaneously.

Figure 10:
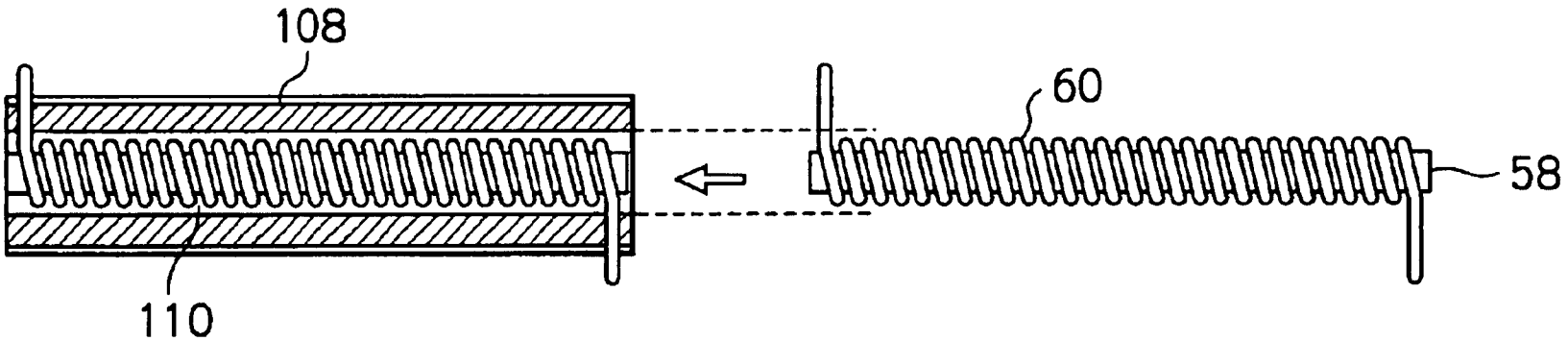
FIG. 10 is an explanatory drawing for explaining the work of inserting the ceramic rod with fusible member wound therearound into the through-hole of the main body.

Procedure of assembly of the miniature fuse of surface mount type according to the present invention will now be explained. Firstly, referring to FIG. 10, explanation is made as to the work of inserting the ceramic rod with the fusible member wound therearound through the through-bore of the main body. Since the fusible member 60 wound around the ceramic rod 58 requires such a portion as to be welded to the cap, the tip end of the fusible member 60 is preferably bent to extend vertically for some millimeters with respect to the longitudinal direction. However, in this condition, it is not easy to insert the fusible member and the ceramic bar 58 into the through-bore 110 provided at the main body of a conventional construction. On the other hand, according to the second embodiment of the present invention, the fusible member 60 and the ceramic rod 58 in the condition shown in FIG. 10 can be easily placed on the recessed portion 64 of the lower ceramic casing 54 from above. Then, the tip end 76 of the fusible member 60 is passed through the cut-out portion 70 to be pulled outwardly from the lower ceramic casing 54 and, as shown in detail in the enlarged view A in FIG. 9, the tip end is bent along the face of the recessed portion 72 to be oppositely engaged with the recessed portion 72 so that they face each other. Thus, according to the present invention, productivity can be enhanced owing to the split type casings.

Then, as shown in FIG. 8, the upper ceramic casing 52 is laid on the lower ceramic casing 54 and the caps 56 are fit onto the opposite end portions of the rectangular ceramic casing 50 of split type.

Figure 11:
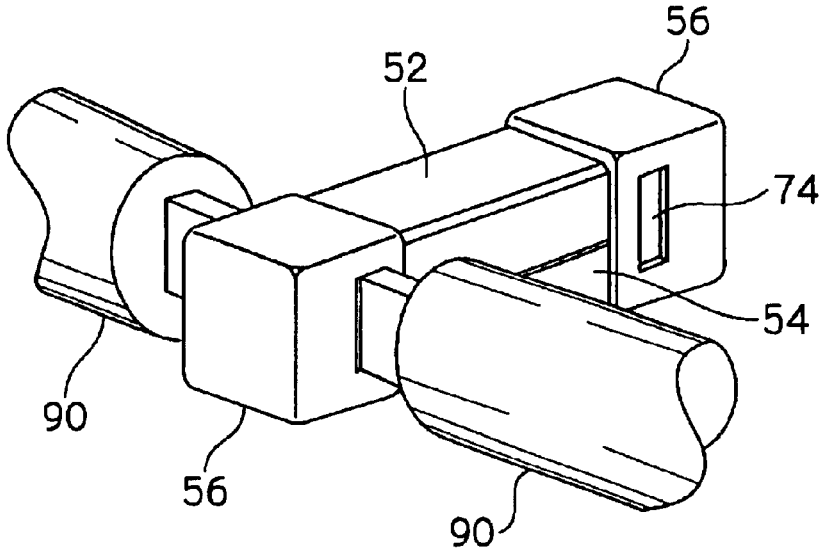
FIG. 11 is a schematic view illustrating the welding process in the course of assembly of the miniature fuse of surface mount type according to the second embodiment of the present invention.

FIG. 11 is the schematic view showing the process of welding. In FIG. 11, reference numeral 90 designates a pair of welding electrodes. At the positions of the opposite side surfaces of the caps 56 corresponding to the two recessed portions 72 of the rectangular ceramic casing 50 of split type as shown in FIG. 9 (it is to be noted that one of the recessed portions 72 is occupied by the end portion 76 of the fusible member 60), the cap 56 is sandwiched by a pair of the electrodes 90 as shown in FIG. 11. Under this condition, the electric current is caused to flow between the electrodes with the cap being pressed. As the consequence, the cap generates heat whereby the cap 56 and the end portion 76 of the fusible member 60 are welded. Concurrently, as the cap 56 is caused to deform, projections 74 are formed at the cap 56 so as to fit into the recessed portions 72 of the rectangular ceramic casing 50 of split type as shown in FIG. 11, whereby the cap 56 can be secured to the rectangular ceramic casing 50 of split type. It is to be noted that, in FIG. 11, when viewed from outside of the cap 56, the portion designated by the reference numeral 74 appears to be recessed; however, when viewed from inside of the cap, the portion to be fit with the recessed portion 72 appears to be projected; therefore, this portion is referred to as projection.

In the case of the so-called tubular construction provided with a through-hole, at the time of installing the fusible member through the through-hole of the main body, a certain amount of effort has been required to pass the fusible member through the through-hole. However, according to the second embodiment of the present invention, by splitting the rectangular ceramic casing 50 of split type, extension of the fusible member in the casing 50 can be performed by placing the fusible member, which has been extended at a separate site, on the recessed portion of one of the split casings while another split casing is laid over the one of the split casings, thereby allowing the fusible member to be installed in the casing quite easily. As the consequence, productivity of the miniature fuses of surface mount type can be enhanced.

As explained above, since the fusible member 60 and the cap 56 are joined by welding, the distance between the terminals of the fusible member 60 can be kept constant without variation caused during assembly, resulting in a stable pre-arcing time-current characteristic. Since the fusing member 60 and the cap 56 are jointed to each other by way of their basic metals, they are not affected by the heat generated at the time of soldering the miniature fuses of surface mount type to the substrates after assembly, whereby stable connection of the fusible member 60 and the cap 56 can be maintained at the time of mounting to the substrates.

Furthermore, the rectangular ceramic casing 50 of split type and the cap 56 are heated and pressurized so as to deform the cap 56 to form the projections 74 of the cap 56, and then the recessed portion 74 are fit into the recessed portions 72 of the rectangular ceramic casing 50 of split type. Thereby, the rectangular ceramic casing 50 of split type and the cap 56 are secured without use of metals having a low melting temperature such as soldering material. Accordingly, the cap 56 will not be detached from the rectangular ceramic casing 50 of split type due to the heat generated at the time of soldering the miniature fuse of surface mount type to the substrate after assembly.

In addition to the above, according to the second embodiment of the present invention, Jointing of the cap 56 and the fusible member 60 and fixing of the cap 56 and the rectangular ceramic casing 50 of split type can be attained in one process. Since the caps 56 are inserted into the opposite ends of the casing with the upper and lower ceramic casings 52, 54 of split type being aligned, they may not be disassembled under a normal condition of use without applying adhesive and the like. Furthermore, since the caps 56 are caused to deform in conformity with the recessed portions 72 formed at the side surfaces of the rectangular ceramic casing 50 of split type, the rectangular ceramic casing 50 of split type and the caps 56 are fixed to each other reliably without disassembling the miniature fuses of surface mount type under a normal condition of use. Thus, the production processes can be simplified and the production costs can be reduced.

It is to be noted that, although the recessed portions 72 are provided at both the upper and the lower ceramic casing 52 and 54 according to the second embodiment of the present invention, they may be provided at either of them.

As shown in FIG. 8 and FIG. 9, between the cap 56 and the interior cavity of the rectangular ceramic casing 50 of split type, there are provided end walls 78 of ceramic material, which have the same function as the lids according to the previous embodiment. Accordingly, the cap can withstand high inner pressure at the time of breaking and is thus more rigid than the case of the inner side of the caps 56 being exposed directly to the interior cavity of the casing. Furthermore, since the end walls 78 are provided between the portion of the fusible member 60 existing inside the interior cavity and also in proximity to the cap 56 and the caps 56, even if arcs are generated at the time of breaking, such arcs can be easily extinguished. As a consequence, the breaking capacity can be increased.

Various variants of the present invention will now be explained.

Figure 12:
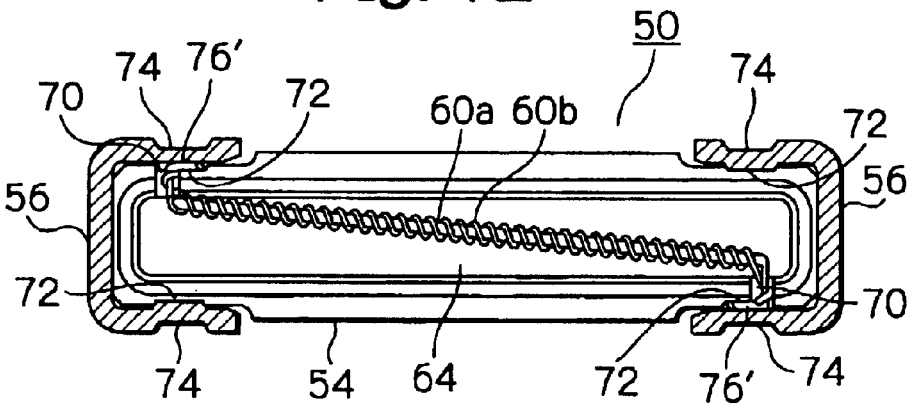
FIG. 12 is a longitudinal sectional view of the miniature fuse of surface mount type according to the present invention using the fusible member of double wound wires construction in the upper surface direction.

FIG. 12 is the longitudinal sectional view of the miniature fuse of surface mount type utilizing such an construction of the fusible member including the support member being different from that of the second embodiment in that the double wound wire construction is employed. For those parts of the construction which are the same as those of the second embodiment, explanation is omitted. Only the differences will be explained. As shown in FIG. 12, the second fusible member **60*b* of wire form is wound around the first fusible member 60*a* of wire form. Two fusible members 60*a* and 60*b* of wire form thus wound are held in the recessed portion 64 of the lower ceramic casing 54 between the opposite cut-out portions 70 and the end portions 76' of two fusible members 60*a* and 60*b* of wire form thus wound are engaged with the side surfaces of the rectangular ceramic casing 50 of split type via the cut-out portions 70, and connected to the cap 56** by welding. It is to be understood that the two fusible members of wire form may be twisted around each other, for example, or may be wound in any suitable way so long as they provide double wire winding construction.

Figure 13:
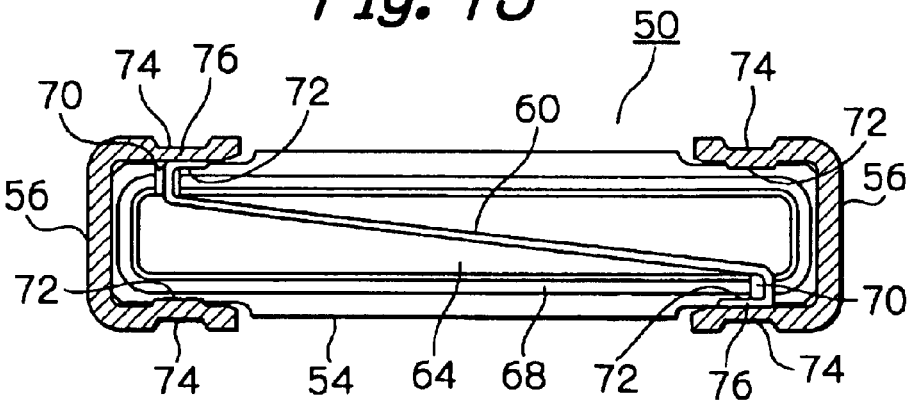
FIG. 13 is a longitudinal sectional view of the miniature fuse of surface mount type according to the present invention using the fusible member of single wire construction in the upper surface direction.
Figure 14:
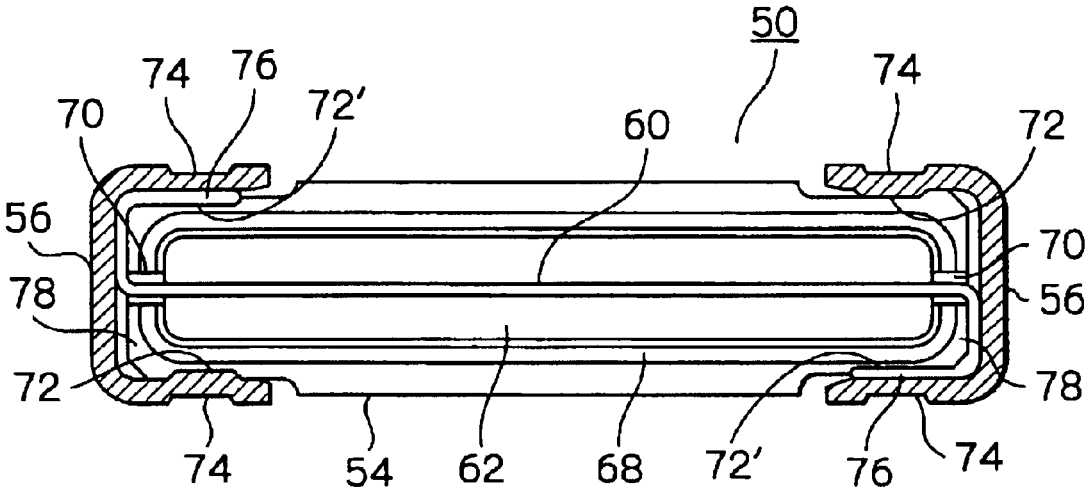
FIG. 14 is a longitudinal sectional view of the variation of a embodiment

FIG. 13 is the longitudinal sectional view taken in the direction of the upper surface of the miniature fuse of surface mount type which employs single wire construction as the construction of the fusible member including the support member which is different from that of the second embodiment. For the part of the construction same as that of the second embodiment, explanation is not repeated but only the difference will now be explained. As shown in FIG. 13, the fusible member 60 of a single wire is held in the recessed portion 64 of the lower ceramic casing 54 between the opposite cut-out portions 70, and the end portions 76 of the fusible member are engaged with the side surface of the rectangular ceramic casing 50 of split type and connected to the cap 56 by welding. FIG. 14 is the longitudinal sectional view taken in the direction of the upper surface of the variant of the embodiment shown in FIG. 13. It is seen that the cut-out portions 70 are not provided at the side surface of the end portion of the lower ceramic casing 54 but at the opposing end surfaces as shown in the drawing. The cut-out portions are also provided at the corresponding positions also at the upper ceramic casing 52 not shown. The recessed portions 72' to which the end portions 76 of the fusible member 60 are engaged extend to the end surfaces of the lower ceramic casing 54. It is preferable from the production point of view that same configuration of the recessed portion 72' is also applied to the upper ceramic casing 52 not shown. According to the present invention, however, the recessed portion 72' should not necessarily extend to the end surface of the upper ceramic casing. 52.

The end portion 76 of the fusible member 60 is bent, having passed through the cut-out portion 70, and extended along the end surface of the lower ceramic casing 54. Then, it is bent at the corner of the end surface and extended along the face of the recessed portion 72' to the welded position and engaged.

Figure 15A:
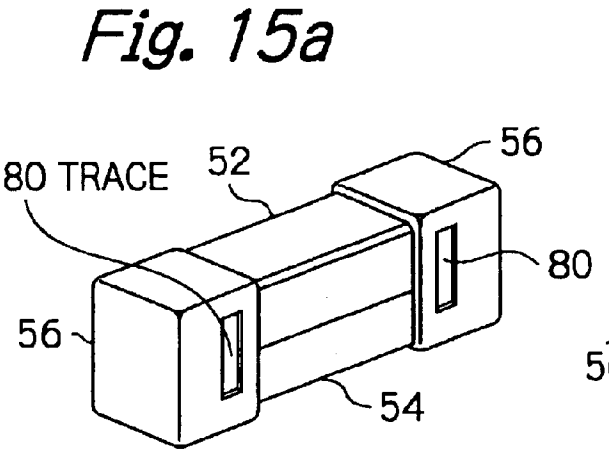
FIG. 15*a* to 15*e* and the illustrate various welding positions and various welding patterns.
Figure 15C:
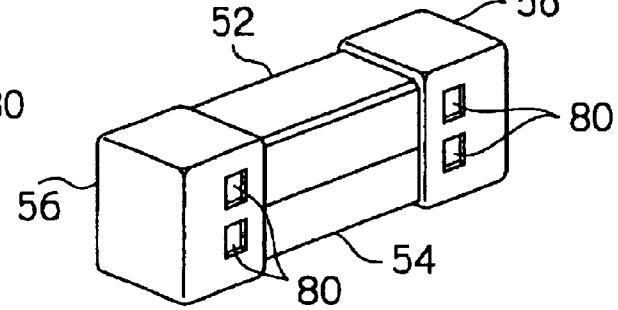
Figure 15B:
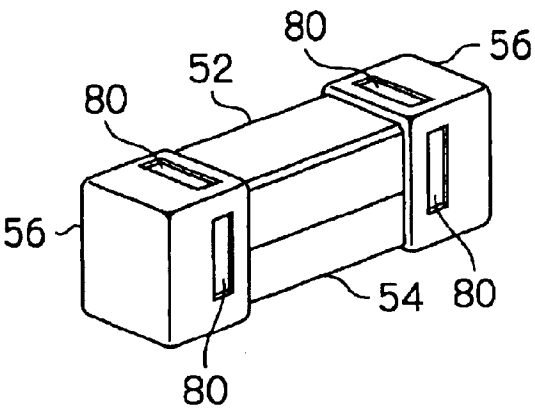
Figure 15D:
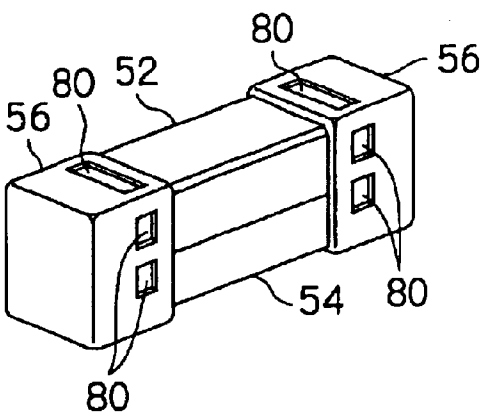
Figure 15E:
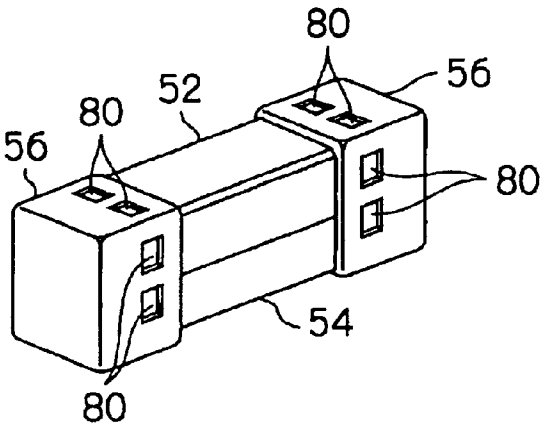

According to the present invention, it is possible to assume various positions and patterns of welding. FIGS. 15*a* to 15*e* illustrate examples of various positions and patterns of welding. FIG. 15*a* shows a case in which the welding positions are located only at the side surfaces in the same manner as the previous embodiment; FIG. 15*b* shows a case in which the clearance between the rectangular ceramic casing 50 of split type and the caps 56 are absorbed, and the welding positions are located both at the side surfaces and the upper and lower surfaces so as to put tightly together both of the split casings, namely, the upper and lower ceramic casings 52 and 54; FIG. 15*c* shows a case in which the welding positions are only located at the side surfaces and the welding pattern is of double type so that the welded part of the fusible member may not collapse excessively in case the thickness of the fusible member being relatively large. FIG. 15*d* shows a case in which the welding patterns at the side surfaces are of double type but those at the upper and lower surfaces are the same as those in the case of FIG. 15*b*; FIG. 15*e* shows a case in which welding patterns both at the side and upper and lower surfaces are of double type In order to enable the electrode having a single type of tip end shape, as well as other reasons. It is to be noted in FIGS. 15*a* to 15*e* that reference numeral 80 designates welding traces. It should be understood that the welding traces provided at the caps at the locations corresponding to those of the recessed portions 72 (not shown in FIGS. 15*a* to 15*e*) provided at the upper and lower ceramic casings 52, 54 are deformed to project so that they fit into the recessed portions 72 (see the recessed portions 72 and projections 74 shown in FIG. 9) whereby the caps 56 are fixed to the rectangular ceramic casing of split type in the same manner as that explained in the second embodiment of the present invention.

Figure 16:
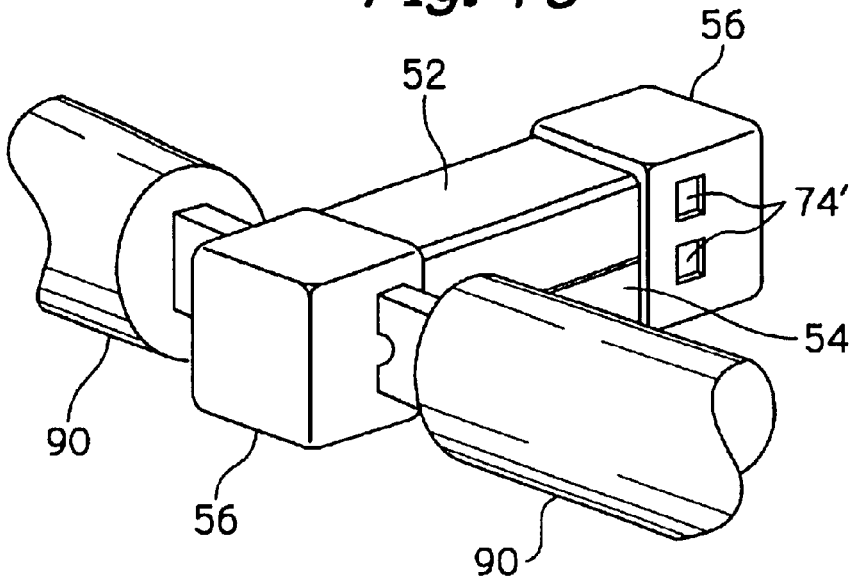
FIG. 16 illustrates the configuration of the tip ends of the electrodes to be used in the two-way welding by use of FIGS. 15*c* to 15*e* and the welding process thereof.

FIG. 16 illustrates the configuration of the tip ends of the electrodes to be used for welding of double type as shown in FIGS. 15*c* through 15*e* and the process of welding. It can be seen that the tip end of the electrode 90 is separated in two ways and with regard to the welding traces to be provided at the locations corresponding to the recessed portions 72(not'shown) provided at the upper and lower ceramic casings 52, 54, two projections 74' to be fit into the recessed portions 72 will be formed at the time of welding.

Figure 17:
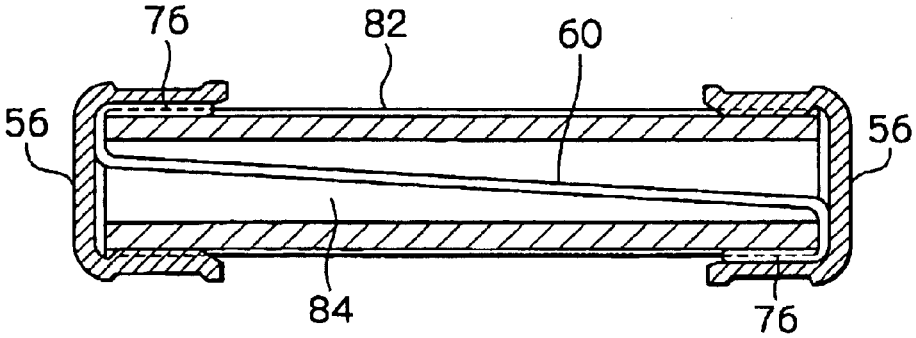
FIG. 17 illustrates an aspect of the present invention of connecting the cap and the fusible member by welding in the application wherein the main body has a through-hole and of interal columnar construction made of heat resistant insulating material.

FIG. 17 illustrates an example of an aspect of the present invention for connecting the caps and the fusible members by welding being applied to the main body which has a through-hole and is a one-piece columnar construction made of heat resistant insulating material. The fusible member of a single wire is passed through the through-hole 84 of the main body 82, and the tip ends 76 of the fusible member 60 are bent along the end surfaces of the main body and engaged with the main body 82 along the side surfaces of the main body 82. The main body 82 may be made of ceramic material. The tip ends 76 of the fusible member 60 and the caps 56 are connected by welding in the same manner as that explained in the second embodiment of the present invention. In case that the main body 82 is made of ceramic material, fixation between the caps 56 and the main body 82 is not so strong as the fitting of the recessed portions 72 of the rectangular ceramic casing 50 of split type relative to the projection 74 of the caps 56 as in the second embodiment. However, for augmenting the strength of the fixation, both side surfaces and the upper and lower surfaces may be welded, for example, as shown in FIGS. 15*1*, 15*d* and 15*e*.

Figure 18:
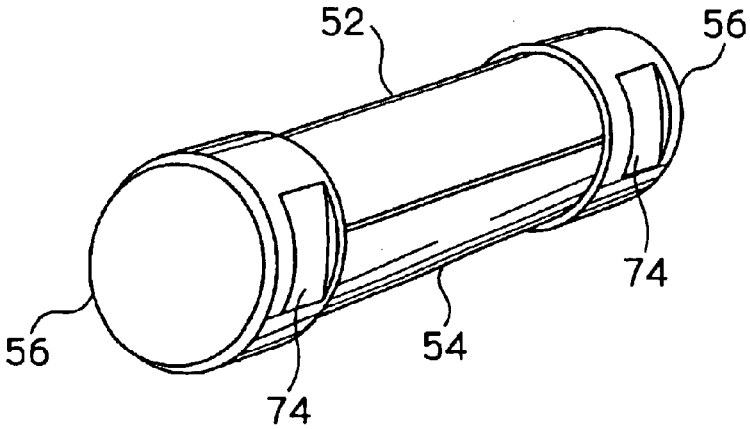
FIG. 18 miniature fuse of surface mount type according to the present invention wherein the main body is cylindrical illustrated in FIG. 13 in the upper surface direction.

According to the embodiments as described above, although the columnar shape of the main body is rectangular, the configuration of the main body is not limited to this rectangular configuration, and any other columnar configuration may be applied. FIG. 18 illustrates an example of the miniature fuse of surface mount type which is cylindrical.

The present invention has been described by referring in detail to certain preferred embodiments, and further changes and modifications of the present invention are clearly feasible within the spirit and scope of the present invention.

What is claimed is:

1. A miniature fuse of surface mount type including a fusible member, a main body made of heat resistant insulating material and a pair of conductive terminals, wherein said main body has a columnar configuration, a pair of opposite end portions and a cavity defined inside of said main body between said pair of end portions, said fusible member is disposed in said cavity of said main body between said pair of end portions, the opposite end portions of said fusible member are extended outwardly onto the outer surface of said main body from the pair of end portions of said main body or from the vicinities thereof, the respective conductive terminals are fit onto the respective end portions of said main body and electrically connected to the respective end portions of said fusible member, and wherein;

said main body is comprised of two split members which are separated in the direction that said pair of end Portions are connected;

each of said two split members has a split member side surface, a pair of split member end portions and a joint end surface;

the respective split member side surface of said two split members are adapted to form the columnar configuration of said main body when said two split members are joined to form said main body;

the respective split member end portions of said two split members are adapted to form the end portions of said main body when said two split members are joined to form said main body;

the joint end surface of one of said two split members is adapted to be joined to the joint end surface of the other of said two split members when said two split members are joined to form said main body;

at least one of said two split members has at least one recessed portion provided on said split member side surface in the vicinity of each of said two split member end portions, said at least one recessed portion extending to said joint end surface; and each of said conductive terminals has a projection fitted in one of said recessed portions provided on said split member side surface in order to fix each of said conductive terminals to said main body, wherein;

said at least one recessed portion provided on said split member side surface in the vicinity of each of said two split member end portions of said at least one split member is spaced apart from each of said two split member end portions of said at least one split member.

2. A miniature fuse of surface mount type according to claim 1, wherein:

the other of said two split members also has at least one recessed portion provided on said split member side surface in the vicinity of each of said two split member end portions, said recessed portions extending to said joint end surface;

the recessed portions of said split members form one recessed portion on the surface of the columnar configuration when said two split members are jointed to form said main body; and said at least one recessed portion provided on said split member side surface in the vicinity of each of said two split member end portions of said other split member is spaced apart from each of said two split member end portions of said other split member.

3. A miniature fuse of surface mount type according to claim 2, wherein:

said conductive terminals are metallic caps;

the end portions of said fusible members are connected to said metallic caps by welding, and said projection of each of said metallic caps is formed as the end portions of said fusible members are welded to said metallic caps.

4. A miniature fuse of surface mount type according to claim 2, wherein said main body is made of ceramic material.

5. A miniature fuse of surface mount type including a fusible member, a main body made of heat resistant insulating material and a pair of conductive terminals, wherein said main body has a columnar configuration, a pair of opposite end portions and a cavity defined inside of said main body between said pair of end portions, said fusible member is disposed in said cavity of said main body between said pair of end portions, the opposite end portions of said fusible member are extended outwardly onto the outer surface of said main body from the pair of end portions of said main body or from the vicinities thereof, the respective conductive terminals are fit onto the respective end portions of said main body and electrically connected to the respective end portions of said fusible member, and wherein:

said main body is comprised of two split members which are separated in the direction that said pair of end portions are connected;

each of said two split members has a split member side surface, a pair of split member end portions and a joint end surface;

the respective split member side surface of said two split members are adapted to form the columnar configuration of said main body when said two split members are joined to form said main body;

the respective split member end portions of said two split members are adapted to form the end portions of said main body when said two split members are joined to form said main body;

the joint end surface of one of said two split members is adapted to be joined to the joint end surface of the other of said two split members when said two split members are joined to form said main body;

at least one of said two split members has at least one recessed portion provided on said split member side surface in the vicinity of each of said two split member end portions, said at least one recessed portion extending to said joint end surface; and each of said conductive terminals has a projection fitted in one of said recessed portions provided on said split member side surface in order to fix each of said conductive terminals to said main body, wherein:

said at least one split member further includes two cut-out portions through which said opposite end portions of said fusible member are extended from said cavity of said main body to said outer surface of said main body, respectively;

said two cut-out portions are provided on said joint end surface of said at least one split member; and each of said two cut-out portions is located at the position on said split member side surface of said at least one split member, where said recessed portion is provided.

6. A miniature fuse of surface mount type according to claim 5, wherein:

the other of said two split members also has at least one recessed portion provided on said split member side surface in the vicinity of each of said two split member end portions, said at least one recessed portion extending to said joint end surface;

said other split member further comprises two cut-out portions through which said opposite end portions of said fusible member are extended from said cavity of said main body to said outer surface of said main body, respectively;

said two cut-out portions are provided on said joint end surface of said other split member;

each of said two cut-out portions is located at the position on said split member side surface of said other split member, where said recessed portion is provided; and each of said two cut-out portions of said at least one split member and each of said two corresponding cut-out portions of said other split member form one hole when said two split members are joined to form said main body.

7. A miniature fuse of surface mount type according to claim 5, wherein:

the end portions of said fusible member are extended on the bottom surface of said recessed portions through said cut-out portions;

said conductive terminals are metallic caps;

the end portions of said fusible member are connected to said metallic caps by welding, and said projections of said metallic caps are formed as the end portions of said fusible member are connected to said metallic caps by welding.

8. A miniature fuse of surface mount type according to claim 6, wherein:

the end portions of said fusible member are extended on the bottom surface of said recessed portions through said cut-out portions;

said conductive terminals are metallic caps;

the end portions of said fusible member are connected to said caps by welding, and said projections of said metallic caps are formed as the end portions of said fusible member are connected to said metallic caps by welding.

9. A miniature fuse of surface mount type according to claim 7 wherein said main body is made of ceramic material.

10. A miniature fuse of surface mount type according to claim 8, wherein said main body is made of ceramic material.

* * * * *